US009783873B2

(12) United States Patent
Reynolds et al.

(10) Patent No.: US 9,783,873 B2
(45) Date of Patent: Oct. 10, 2017

(54) SUPERALLOY COMPOSITIONS, ARTICLES, AND METHODS OF MANUFACTURE

(75) Inventors: Paul L. Reynolds, Tolland, CT (US); Darryl Slade Stolz, Newington, CT (US)

(73) Assignee: United Technologies Corporation, Farmington, CT (US)

( * ) Notice: Subject to any disclaimer, the term of this patent is extended or adjusted under 35 U.S.C. 154(b) by 857 days.

(21) Appl. No.: 13/372,585

(22) Filed: Feb. 14, 2012

(65) Prior Publication Data

US 2013/0209265 A1 Aug. 15, 2013

(51) Int. Cl.

| | |
|---|---|
| ***C22C 19/05*** | (2006.01) |
| ***C22C 1/04*** | (2006.01) |
| ***C22C 30/00*** | (2006.01) |
| ***C22F 1/10*** | (2006.01) |
| ***B22F 5/00*** | (2006.01) |

(52) U.S. Cl.

CPC ..... *C22C 19/056* (2013.01); *B22F 5/009* (2013.01); *C22C 1/04* (2013.01); *C22C 1/0433* (2013.01); *C22C 19/057* (2013.01); *C22C 30/00* (2013.01); *C22F 1/10* (2013.01)

(58) Field of Classification Search

USPC ..... 420/448

See application file for complete search history.

(56) References Cited

U.S. PATENT DOCUMENTS

| | | | | |
|---|---|---|---|---|
| 3,061,426 | A | 10/1962 | Bieber | |
| 4,209,348 | A | 6/1980 | Duhl et al. | |
| 4,569,824 | A | 2/1986 | Duhl et al. | |
| 4,719,080 | A | 1/1988 | Duhl et al. | |
| 4,894,089 | A | 1/1990 | Henry | |
| 5,104,614 | A | 4/1992 | Ducrocq et al. | |
| 5,270,123 | A | 12/1993 | Walston et al. | |
| 5,662,749 | A | 9/1997 | Chang | |
| 5,888,316 | A * | 3/1999 | Erickson | 148/410 |
| 6,355,117 | B1 | 3/2002 | DeLuca et al. | |
| 6,521,175 | B1 * | 2/2003 | Mourer et al. | 420/448 |
| 6,706,241 | B1 | 3/2004 | Baumann et al. | |
| 6,908,519 | B2 | 6/2005 | Raymond et al. | |
| 8,147,749 | B2 * | 4/2012 | Reynolds | 420/448 |
| 2010/0008790 | A1 | 1/2010 | Reynolds | |

(Continued)

FOREIGN PATENT DOCUMENTS

| | | | |
|---|---|---|---|
| EP | 0292320 | A2 | 11/1988 |
| EP | 1195446 | A1 | 4/2002 |

(Continued)

OTHER PUBLICATIONS

Chang, D. R., D. D. Krueger, and R. A. Sprague. "Superalloy powder processing, properties and turbine disk applications." Superalloys 1984 (1984): 245-73.*

(Continued)

*Primary Examiner* — Jessee Roe

(74) *Attorney, Agent, or Firm* — Bachman & LaPointe, P.C.

(57) ABSTRACT

A composition of matter comprises, in combination, in weight percent: a content of nickel as a largest content; 3.10-3.75 aluminum; 0.02-0.09 boron; 0.02-0.09 carbon; 9.5-11.25 chromium; 20.0-22.0 cobalt; 2.8-4.2 molybdenum; 1.6-2.4 niobium; 4.2-6.1 tantalum; 2.6-3.5 titanium; 1.8-2.5 tungsten; and 0.04-0.09 zirconium.

26 Claims, 4 Drawing Sheets

(56) References Cited

U.S. PATENT DOCUMENTS

| | | | |
|---|---|---|---|
| 2010/0158695 | A1 | 6/2010 | Reynolds |
| 2010/0303665 | A1 | 12/2010 | Bain et al. |
| 2010/0303666 | A1 | 12/2010 | Bain et al. |
| 2010/0329876 | A1 | 12/2010 | Bain et al. |
| 2010/0329883 | A1 | 12/2010 | Mourer et al. |
| 2011/0203707 | A1 | 8/2011 | Mourer et al. |
| 2013/0209266 | A1 | 8/2013 | Reynolds et al. |

FOREIGN PATENT DOCUMENTS

| | | | |
|---|---|---|---|
| EP | 1201777 | A1 | 5/2002 |
| EP | 1710322 | A1 | 10/2006 |

OTHER PUBLICATIONS

Furrer, David, and Hans Fecht. "Ni-based superalloys for turbine discs." JOM51.1 (1999): 14-17.*

European Search Report for European Patent Application No. 12180468.6. dated Jul. 12, 2013.

European Search Report for EP Patent Application No. 12180475.1, dated Jul. 23, 2011.

European Search Report for EP Patent Application No. 12180475.1, dated May 6, 2014.

* cited by examiner

TABLE I
Compositions (in Weight Percent Except as Noted)

| | Example Disk Alloy | | | | | | | | | | Prior Art Nominal | | | |
|---|---|---|---|---|---|---|---|---|---|---|---|---|---|---|
| | Exemplary Specifications | | | | | | | | | | US '790 | IN100 | NF3 | ME16 |
| | Alloy A | | | | Alloy B | | | | Common | | | | | |
| | Nom. | Min. | Max. | Test | Nom. | Min. | Max. | Test | Min. | Max | | | | |
| Al | 3.50 | 3.30 | 3.70 | 3.53 | 3.41 | 3.18 | 3.63 | 3.41 | 3.10 | 3.75 | 3.14 | 5.0 | 3.6 | 3.4 |
| B | 0.040 | 0.035 | 0.050 | 0.040 | 0.025 | 0.020 | 0.030 | 0.030 | 0.02 | 0.09 | 0.03 | 0.02 | 0.03 | 0.025 |
| C | 0.034 | 0.030 | 0.040 | 0.035 | 0.040 | 0.025 | 0.055 | 0.029 | 0.02 | 0.09 | 0.03 | 0.07 | 0.03 | 0.05 |
| Co | 20.80 | 20.40 | 21.20 | 20.49 | 20.90 | 20.60 | 21.20 | 20.93 | 20.0 | 22.0 | 19.60 | 18.5 | 18.0 | 20.6 |
| Cr | 10.20 | 10.00 | 10.40 | 10.18 | 10.45 | 10.05 | 10.85 | 10.44 | 9.5 | 11.25 | 10.09 | 12.4 | 10.5 | 13.0 |
| Cu | | | 0.000 | <0.01 | | | 0.000 | | | 0.005 | | | | |
| Fe | | | 0.1 | 0.028 | | | 0.1 | | | 0.15 | | | | |
| Hf | | | 0.05 | <0.01 | | | 0.05 | | | 0.5 | 0.40 | | | |
| Mn | | | 0.004 | 0.001 | | | 0.004 | | | 0.005 | | | | |
| Mo | 3.65 | 3.45 | 3.85 | 3.61 | 3.30 | 3.05 | 3.55 | 3.34 | 2.8 | 4.2 | 2.79 | 3.2 | 2.9 | 3.8 |
| Nb | 2.09 | 1.89 | 2.29 | 2.08 | 1.85 | 1.70 | 2.00 | 1.88 | 1.6 | 2.4 | 1.55 | | 2.0 | 0.9 |
| S | | | 0.0005 | <0.001 | | | 0.0005 | | | 0.0005 | | | | |
| Si | | | 0.1 | <0.01 | | | 0.1 | | | 0.1 | | | | |
| Ta | 4.70 | 4.50 | 4.90 | 4.76 | 4.50 | 4.30 | 4.70 | 4.41 | 4.2 | 6.1 | 7.28 | | 2.5 | 2.4 |
| Ti | 3.10 | 2.90 | 3.30 | 3.03 | 3.00 | 2.75 | 3.25 | 3.03 | 2.6 | 3.5 | 2.17 | 4.3 | 3.6 | 3.7 |
| V | | | 0.0 | <0.01 | | | 0.0 | | | 0.1 | | 0.8 | | |
| W | 2.20 | 2.00 | 2.40 | 2.22 | 2.00 | 1.90 | 2.10 | 2.06 | 1.8 | 2.5 | 2.62 | | 3.0 | 2.1 |
| Zr | 0.055 | 0.040 | 0.075 | 0.058 | 0.06 | 0.050 | 0.070 | 0.052 | 0.04 | 0.09 | 0.05 | 0.06 | 0.05 | 0.05 |
| $O_2$* | | | 150 | 174 | | | 150 | | | | | | | |
| $N_2$* | | | 100 | 26 | | | 100 | | | | | | | |
| Ni | Bal | | Bal | Bal | Bal | | Bal | Bal | | Bal | Bal | Bal | Bal | Bal |

*PPM

FIG. 3

| TABLE II Physical Properties | | | | | | | | | |
|---|---|---|---|---|---|---|---|---|---|
| Property | "A" Sample | Prior Art | | | | % Improvement over | | | |
| | | IN100 | US '790 | NF3 | ME16 | IN100 | US '790 | NF3 | ME16 |
| Time to Rupture (Hours) 816°C (1500°F) 448 MPa (65ksi) | 126 | 50 | 397 | 322 | 92 | 152% | -68% | -61% | 37% |
| Time to 0.5% Creep Deformation (Hours) 816°C (1500°F) 448 MPa (65ksi) | 27 | <10 | 82 | 57 | 15 | 200% | -67% | -53% | 80% |
| Ultimate Tensile Strength (MPa (ksi)) 816°C (1500°F) | 997.7 (144.7) | 1034.2 (150) | 1118.3 (162.2) | 1073.5 (155.7) | 1016.3 (147.4) | -4% | -11% | -7% | -2% |
| Yield Strength (MPa (ksi)) 816°C (1500°F) | 968.0 (140.4) | 923.9 (134) | 897.7 (130.2) | 874.9 (126.9) | 807.4 (117.1) | 5% | 8% | 11% | 20% |
| Ultimate Tensile Strength (MPa (ksi)) 732°C (1350°F) | 1253.5 (181.8) | 1282.4 (186) | 1351.4 (196.0) | 1285.9 (186.5) | 1286.6 (186.6) | -2% | -7% | -3% | -3% |
| Yield Strength (MPa (ksi)) 732°C (1350°F) | 1065.9 (154.6) | 965.3 (140) | 985.3 (142.9) | 994.9 (144.3) | 957.7 (138.9) | 10% | 8% | 7% | 11% |
| Time to Rupture (Hours) 649°C (1200°F) 910 MPa (132 ksi) | 9380 | 220 | - | 256 | 1045 | 4164% | | 3564 % | 798% |
| Time to 0.2% Creep Deformation (Hours) 649°C (1200°F) 910 MPa (132 ksi) | 470 | 18 | - | 80 | 31 | 2511% | | 488% | 1416% |
| Ultimate Tensile Strength (MPa (ksi)) 649°C (1200°F) | 1510 (219) | 1317 (191) | 1496 (217) | 1462 (212) | 1413 (205) | 15% | 1% | 3% | 7% |
| Yield Strength (MPa (ksi)) 649°C (1200°F) | 1062 (154) | 931 (135) | 1179 (171) | 1089 (158) | 958 (139) | 14% | -10% | -3% | 11% |

FIG. 4

TABLE III Physical Properties:
Coarse Grain (CG (~ASTM 6.5)) and Fine Grain (FG (~ASTM 12.5))

| Property | Test Conditions | Units | "A" Sample CG | ME16 CG | IN100 CG | Sample FG | ME16 FG | IN100 FG |
|---|---|---|---|---|---|---|---|---|
| 0.2% Offset Yield Strength | 260°C (500°F) | MPa (ksi) | 1117 (162) | 1048 (152) | 924 (134) | 1262 (183) | 1151 (167) | 1007 (146) |
| 0.2% Offset Yield Strength | 704°C (1300°F) | MPa (ksi) | 1103 (160) | 1000 (145) | 931 (135) | 1234 (179) | 1138 (165) | 986 (143) |
| 0.2% Offset Yield Strength | 732°C (1350°F) | MPa (ksi) | 1110 (161) | 986 (143) | 945 (137) | 1172 (170) | 1110 (161) | 924 (134) |
| 0.2% Offset Yield Strength | 788°C (1450°F) | MPa (ksi) | 1062 (154) | 958 (139) | 903 (131) | 1048 (152) | 979 (142) | 903 (131) |
| Temperature for 450 Hours to Rupture | 758 MPa (110 ksi) | °C (°F) | 732 (1350) | 703 (1297) | 681 (1258) | 701 (1294) | 677 (1250) | 676 (1248) |
| Rupture Strength for 450 Hours | 732°C (1350°F) | MPa (ksi) | 758 (110) | 648 (94) | 565 (82) | 641 (93) | 455 (66) | 358 (52) |
| Temperature for Notched LCF for Full Life | ≥1448 MPa (≥210 ksi) | °C (°F) | 760 (1400) | 704 (1300) | not generally measured at these high temperature conditions | | | |
| Increased Stress Capability for Dwell Notched LCF for Full Life | 704°C (1300°F) | MPa (ksi) | 241 (35) | Baseline | | | | |
| Fatigue Crack Growth Rate @ 22 MPa-m^0.5 (20 ksi-in^0.5) | 732°C (1350°F) | m/CY (in/CY) | 1.52E-7 (6E-6) | 1.52E-7 (6E-6) | | | | |

FIG. 5

SUPERALLOY COMPOSITIONS, ARTICLES, AND METHODS OF MANUFACTURE

U.S. GOVERNMENT RIGHTS

The invention was made with U.S. Government support under Agreement No. N00421-02-3-3111 awarded by the Naval Air Systems Command. The U.S. Government has certain rights in the invention.

BACKGROUND

The disclosure relates to nickel-base superalloys. More particularly, the disclosure relates to such superalloys used in high-temperature gas turbine engine components such as turbine disks and compressor disks.

The combustion, turbine, and exhaust sections of gas turbine engines are subject to extreme heating as are latter portions of the compressor section. This heating imposes substantial material constraints on components of these sections. One area of particular importance involves blade-bearing turbine disks. The disks are subject to extreme mechanical stresses, in addition to the thermal stresses, for significant periods of time during engine operation.

Exotic materials have been developed to address the demands of turbine disk use. U.S. Pat. No. 6,521,175 (the '175 patent) discloses an advanced nickel-base superalloy for powder metallurgical (PM) manufacture of turbine disks. The disclosure of the '175 patent is incorporated by reference herein as if set forth at length. The '175 patent discloses disk alloys optimized for short-time engine cycles, with disk temperatures approaching temperatures of about 1500° F. (816° C.). US 20100008790 (the '790 publication) discloses a nickel-base disk alloy having a relatively high concentration of tantalum coexisting with a relatively high concentration of one or more other components Other disk alloys are disclosed in U.S. Pat. No. 5,104,614, U.S. Pat. No. 5,662,749, U.S. Pat. No. 6,908,519, EP1201777, and EP1195446.

Separately, other materials have been proposed to address the demands of turbine blade use. Blades are typically cast and some blades include complex internal features. U.S. Pat. Nos. 3,061,426, 4,209,348, 4,569,824, 4,719,080, 5,270,123, 6,355,117, and 6,706,241 disclose various blade alloys.

SUMMARY

One aspect of the disclosure involves a nickel-base composition of matter having a content of nickel as a largest content; 3.10-3.75 aluminum; 0.02-0.09 boron; 0.02-0.09 carbon; 9.5-11.25 chromium; 20.0-22.0 cobalt; 2.8-4.2 molybdenum; 1.6-2.4 niobium; 4.2-6.1 tantalum; 2.6-3.5 titanium; 1.8-2.5 tungsten; and 0.04-0.09 zirconium.

In additional or alternative embodiments of any of the foregoing embodiments the composition comprises, in weight percent: 3.18-3.70 aluminum; 0.020-0.050 boron; 0.025-0.055 carbon; 10.00-10.85 chromium; 20.4-21.2 cobalt; 3.05-3.85 molybdenum; 1.70-2.29 niobium; 4.3-4.9 tantalum; 2.75-3.30 titanium; 1.9-2.4 tungsten; and 0.040-0.075 zirconium.

In additional or alternative embodiments of any of the foregoing embodiments the composition consists essentially of said combination.

In additional or alternative embodiments of any of the foregoing embodiments the composition comprises, if any, in weight percent, no more than: 0.005 copper; 0.15 iron; 0.50 hafnium; 0.0005 sulphur; 0.1 silicon; and 0.1. vanadium.

In additional or alternative embodiments of any of the foregoing embodiments the composition comprises, in weight percent at least one of: 3.3-3.7 aluminum; 0.035-0.05 boron; 0.03-0.04 carbon; 10.0-10.4 chromium; 20.4-21.2 cobalt; 3.45-3.85 molybdenum; 1.89-2.29 niobium; 4.5-4.9 tantalum; 2.9-3.3 titanium; 2.0-2.4 tungsten; and 0.04-0.075 zirconium.

In additional or alternative embodiments of any of the foregoing embodiments the composition comprises, in weight percent: 3.3-3.7 aluminum; 0.035-0.05 boron; 0.03-0.04 carbon; 10.0-10.4 chromium; 20.4-21.2 cobalt; 3.45-3.85 molybdenum; 1.89-2.29 niobium; 4.5-4.9 tantalum; 2.9-3.3 titanium; 2.0-2.4 tungsten; 0.04-0.075 zirconium; and no more than 1.0 percent, individually, of every additional constituent, if any.

In additional or alternative embodiments of any of the foregoing embodiments the composition comprises, in weight percent: 3.18-3.63 aluminum; 0.020-0.030 boron; 0.025-0.055 carbon; 10.05-10.85 chromium; 20.60-21.20 cobalt; 3.05-3.55 molybdenum; 1.70-2.00 niobium; 4.3-4.70 tantalum; 2.75-3.25 titanium; 1.90-2.10 tungsten; 0.050-0.070 zirconium; and no more than 1.0 percent, individually, of every additional constituent, if any.

In additional or alternative embodiments of any of the foregoing embodiments, said content of nickel is at least 50 weight percent.

In additional or alternative embodiments of any of the foregoing embodiments, said content of nickel is 50-53 weight percent.

In additional or alternative embodiments of any of the foregoing embodiments, a weight ratio of said titanium to said aluminum is at least 0.57.

In additional or alternative embodiments of any of the foregoing embodiments, a combined content of said tantalum, aluminum, titanium, and niobium is at least 11.5 percent.

In additional or alternative embodiments of any of the foregoing embodiments, a combined content of said tantalum, aluminum, titanium, and niobium is 12.0-14.2 weight percent.

In additional or alternative embodiments of any of the foregoing embodiments, a combined content of said titanium and niobium is 4.6-5.25 weight percent.

In additional or alternative embodiments of any of the foregoing embodiments, a combined content of said tantalum and aluminum is 7.6-8.2 weight percent.

In additional or alternative embodiments of any of the foregoing embodiments, a weight ratio of said aluminum to said tantalum is 0.7-0.8.

In additional or alternative embodiments of any of the foregoing embodiments, a weight ratio of said molybdenum to said tungsten 1.6-1.9.

In additional or alternative embodiments of any of the foregoing embodiments the composition comprises, in weight percent: no more than 4.0 weight percent, individually, of every additional constituent, if any.

In additional or alternative embodiments of any of the foregoing embodiments the composition comprises, in weight percent: no more than 0.5 weight percent, individually, of every additional constituent, if any.

In additional or alternative embodiments of any of the foregoing embodiments the composition comprises, in weight percent: no more than 4.0 weight percent, total, of every additional constituent, if any.

In additional or alternative embodiments of any of the foregoing embodiments the composition is in powder form.

Another aspect of the disclosure involves a process for forming an article comprising: compacting a powder having the composition of any of the embodiments; forging a precursor formed from the compacted powder; and machining the forged precursor.

In additional or alternative embodiments of any of the foregoing embodiments the process may further comprise: heat treating the precursor, at least one of before and after the machining, by heating to a temperature of no more than 1232° C. (2250° F.)

In additional or alternative embodiments of any of the foregoing embodiments the process may further comprise: heat treating the precursor, at least one of before and after the machining, the heat treating effective to increase a characteristic γ grain size from a first value of about 10 μm or less to a second value of 20-120 μm.

Another aspect of the disclosure involves a gas turbine engine turbine or compressor disk having the composition of any of the embodiments.

Another aspect of the disclosure involves a powder metallurgical article comprising: a content of nickel as a largest content; 3.25-3.75 aluminum; 0.02-0.09 boron; 0.02-0.09 carbon; 9.0-11.0 chromium; 16.0-22.0 cobalt; 2.0-5.0 molybdenum; 1.0-3.5 niobium; 4.2-5.4 tantalum; 2.0-4.5 titanium; 1.8-2.4 tungsten; and 0.04-0.09 zirconium. A combined content of said tantalum, aluminum, titanium, and niobium is at least 11.5 weight percent; a combined content of titanium and niobium is 4.6-5.9 weight percent; and a combined content of tantalum and aluminum is 7.3-8.6 weight percent.

In various implementations, the alloy may be used to form turbine disks via powder metallurgical processes.

The details of one or more embodiments are set forth in the accompanying drawings and the description below. Other features, objects, and advantages will be apparent from the description and drawings, and from the claims.

BRIEF DESCRIPTION OF THE DRAWINGS

FIG. 3 is a table of compositions of an inventive disk alloy and of prior art alloys.

FIG. 4 is a table of select measured properties of the disk alloy and prior art alloys of FIG. 3.

FIG. 5 is a table of additional select measured properties of the disk alloy and prior art alloys of FIG. 3.

Like reference numbers and designations in the various drawings indicate like elements.

DETAILED DESCRIPTION

Figure 1:
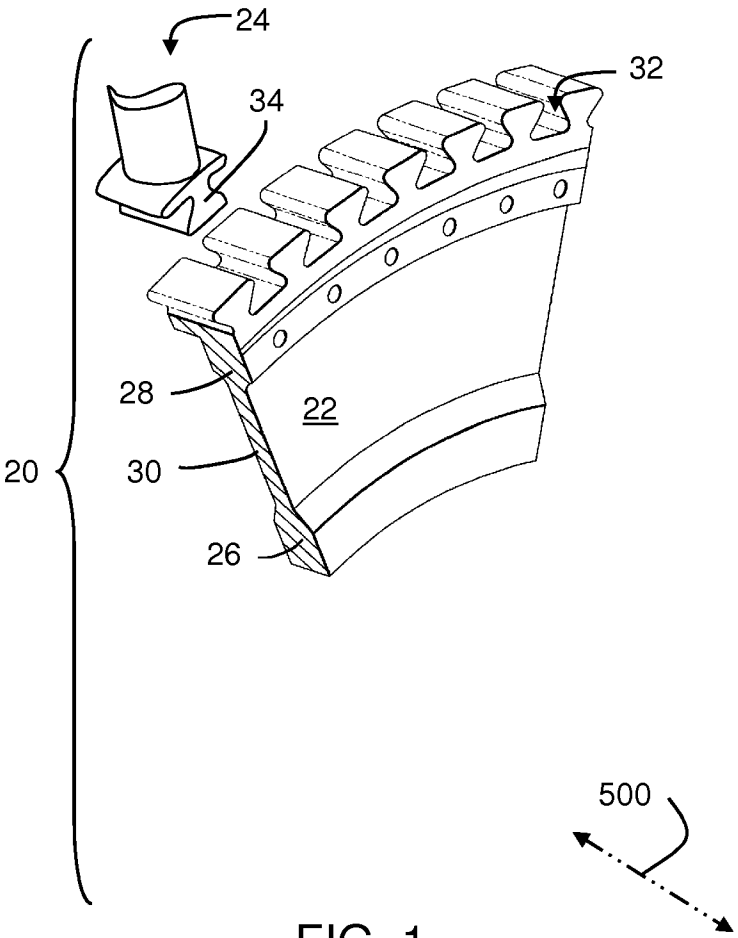
FIG. 1 is an exploded partial view of a gas turbine engine turbine disk assembly.

FIG. 1 shows a gas turbine engine disk assembly 20 including a disk 22 and a plurality of blades 24. The disk is generally annular, extending from an inboard bore or hub 26 at a central aperture to an outboard rim 28. A relatively thin web 30 is radially between the bore 26 and rim 28. The periphery of the rim 28 has a circumferential array of engagement features 32 (e.g., dovetail slots) for engaging complementary features 34 of the blades 24. In other embodiments, the disk and blades may be a unitary structure (e.g., so-called "integrally bladed" rotors or disks).

Figure 2:
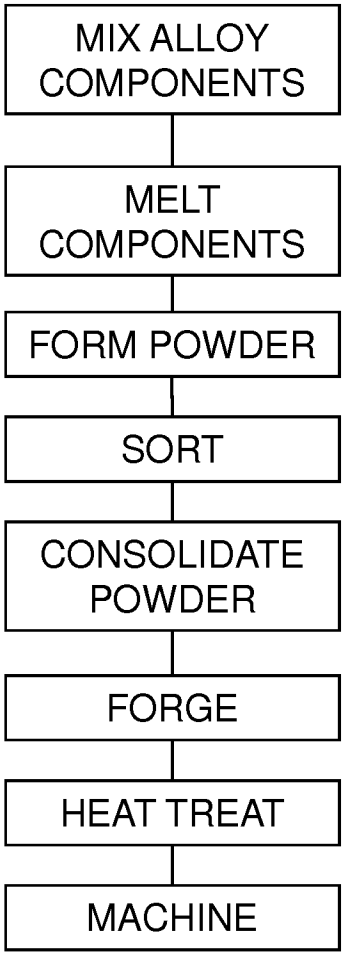
FIG. 2 is a flowchart of a process for preparing a disk of the assembly of FIG. 1.

The disk 22 is advantageously formed by a powder metallurgical forging process (e.g., as is disclosed in U.S. Pat. No. 6,521,175). FIG. 2 shows an exemplary process. The elemental components of the alloy are mixed (e.g., as individual components of refined purity or alloys thereof). The mixture is melted sufficiently to eliminate component segregation. The melted mixture is atomized to form droplets of molten metal. The atomized droplets are cooled to solidify into powder particles. The powder may be screened to restrict the ranges of powder particle sizes allowed. The powder is put into a container. The container of powder is consolidated in a multi-step process involving compression and heating. The resulting consolidated powder then has essentially the full density of the alloy without the chemical segregation typical of larger castings. A blank of the consolidated powder may be forged at appropriate temperatures and deformation constraints to provide a forging with the basic disk profile. The forging is then heat treated in a multi-step process involving high temperature heating followed by a rapid cooling process or quench. Preferably, the heat treatment increases the characteristic gamma (γ) grain size from an exemplary 10 μm or less to an exemplary 20-120 μm (with 30-60 μm being preferred). The quench for the heat treatment may also form strengthening precipitates (e.g., gamma prime (γ') and eta (η) phases discussed in further detail below) of a desired distribution of sizes and desired volume percentages. Subsequent heat treatments are used to modify these distributions to produce the requisite mechanical properties of the manufactured forging. The increased grain size is associated with good high-temperature creep-resistance and decreased rate of crack growth during the service of the manufactured forging. The heat treated forging is then subject to machining of the final profile and the slots.

Improved performance and durability are required of future generation commercial, military, and industrial gas turbine engines. Decreased thrust specific fuel consumption (TSFC) in commercial gas turbine engines and higher thrust-to-weight in military engines will require compressor and turbine disk materials to be able to withstand higher rotational speeds (at smaller cross-sectional sizes). Therefore advanced disk materials will need to have higher resistance to bore burst limits. Advanced disks must be able to withstand higher temperatures, not only in the rim but throughout the disk. The ability to withstand long times and high temperatures requires improved strength, creep to rupture performance and thermo-mechanical fatigue (TMF) resistance. Improved low cycle fatigue (LCF) and high temperature notched LCF are also required.

Table I of FIG. 3 shows two particular specifications for two alloys, identified as Alloy A and Alloy B. It also shows a broader specification for one exemplary alloy or group of alloys (including A and B in common). The nominal composition and nominal limits were derived based upon sensitivities to elemental changes (e.g., derived from phase diagrams). The table also shows a measured composition of test samples. The table also shows nominal compositions of the prior art alloys: (1) of U.S. Pat. No. '790; (2) of NF3 (discussed, e.g., in U.S. Pat. No. 6,521,175); (3) ME16 (discussed, e.g., in EP1195446); and IN-100. Except where noted, all contents are by weight and specifically in weight percent.

The FIG. 3 alloy has been engineered to provide the necessary properties for both disk rim and bore. Beyond the base nickel and the required components, an exemplary alloy has no more than 4.0 percent (more narrowly 2% or 1%), total/combined, of every additional constituent, if any.

Similarly, the exemplary alloy may have no more than 2.0 percent (more narrowly 1% or 0.5%), individually, of every additional constituent, if any (or such lower amounts as may be in the table or may otherwise constitute merely impurity levels). Exemplary nickel contents are 49-55, more narrowly 50-53.

Comparative properties of the Alloy A and prior art samples are seen in FIGS. 4 and 5. There and below, where both English units and metric (e.g., SI) units are present, the English units represent the original data or other value and the metric represent a conversion therefrom. Other tests indicate Alloy B to have similar performances to Alloy A relative to the prior art.

We experimentally derived properties that give, for example: high tensile strength and low cycle fatigue (LCF) resistance in the bore; and high notched LCF capability and creep and rupture resistance needed at the rim.

Unexpected high tensile strength in a coarse grained condition for this alloy approaches that of the fine grained condition of the latest generation of disk alloys: ME16 (aka ME3); and René 104. This will permit an enabling higher stress in the bore of the disk, potentially without the need to utilized dual property, dual microstructure or dual heat treat processes to provide the necessary tensile strength and LCF capabilities. Rupture strengths for the coarse grained part show up to 9× the capability of coarse grain ME16 at 1200° F. (649 C) and a 16 ksi (110 MPa) improvement at 1350° F. (732 C). Notched LCF strength is 40 ksi (276 MPa) or 100° F. (56K(C)) greater than ME16. Two-minute dwell LCF at 1300° F. (704 C) shows approximately 35 ksi (241 MPa).

Whereas typical modern disk alloy compositions contain 0-3 weight percent tantalum (Ta), the present alloys have a higher level. More specifically, levels above 3% Ta (e.g., 4.2-6.1 wt %) combined with relatively high levels of other γ' formers (namely, one or a combination of aluminum (Al), titanium (Ti), niobium (Nb), tungsten (W), and hafnium (Hf)) and relatively high levels of cobalt (Co) are believed unique. The Ta serves as a solid solution strengthening additive to the γ' and to the γ. The presence of the relatively large Ta atoms reduces diffusion principally in the γ' phase but also in the γ. This may reduce high-temperature creep. At higher levels of Ta, formation of η phase can occur. These exemplary levels of Ta are less than those of the U.S. Pat. No. '790 example. The exemplary alloys were selected based upon trends observed/discussed in copending application Ser. No. 13/372,590 entitled Superalloy Compositions, Articles, and Methods of Manufacture and filed on even date herewith (the '9404 application).

As discussed in the '9404 application, a number of elemental relationships (mostly dealing with aluminum, chromium, and tantalum) not previously reported were found to have a large impact on a number of properties, including but not necessarily limited to high temperature strengths, creep, and rupture. The exemplary alloys were developed through rigorous optimization of these elemental relationships in order to yield an advantageous blend of these properties.

First, the optimums in creep and high temperature strength do not appear until Ta is approximately 1.35 atomic % (approximately 4.2 weight %), and with diminishing returns on its effect after approximately 2.0 atomic % (approximately 6.1 weight %) due to a density increase without a property increase. Additionally, it is suspected, but not experimentally proven, that exemplary notched dwell low cycle fatigue (LCF) is dependent on Ta content.

Secondly, the sum of the primary elements (Al, Ti, Ta, and Nb) that form gamma prime, are between approximately 11.5 and 15.0 wt %, more narrowly 12.0-14.2 wt % and an exemplary level of 12.8 or 13.4 wt %. This provides benefits in creep and high temperature strength (and possibly notched dwell LCF). An exemplary combined content of Nb and Ti does not exceed 5.9 wt % due to undesirable phase formation and is at least 4.6 wt % to maintain rupture resistance, more narrowly 4.6-5.25 wt %. Therefore, an exemplary combined content of Al+Ta is between 7.3 and 8.6 wt %, more narrowly 7.6-8.2 wt %, to maintain high strength capability.

Thirdly, the ratio of Al/Ta should be between 0.67 and 0.83 (using wt %), more narrowly 0.7-0.8. This provides the maximum gamma prime flow stress at the highest possible temperature. This manifests itself in very high yield strength in the alloy at 1250° F. (677° C.) and resists, to some extent, decrease of yield strength as high as 1500° F. (816° C.). The higher values of this ratio will produce higher ductility, but lower tensile and rupture capabilities. The lower values will produce undesirable phase formation and lower ductility.

Fourth, the Mo/W ratios in this alloy may be maintained to prevent low ductility at temperatures above 1000° F. (538° C.) and up to 2200° F. (1204° C.). A target ratio is 1.65 (using wt %), more broadly 1.6-1.9, but can be as high as 2.1 and as low as 1.5 without disruption of the desired properties. Significantly lower values produce low high temperature ductility (resulting in lower resistance to quench cracking) and higher values do not have the desired levels of ultimate tensile strength at temperatures from room temperature to 2100° F. (1149° C.) and resistance to creep at 1200° F. (649° C.) and above.

In addition to the exemplary specification "common" to Alloy A and Alloy B, a narrower range of one or all its components may be provided by selecting the lower min and higher max values from the two individual specifications. Additionally, one or more of the foregoing relationships (ratios, sums, etc.) may be superimposed to further limit the compositional possibilities.

Maximum strengths occur around 1200° F. (649 C) because of the design for balanced properties with the high content of gamma prime, and a very high refractory content (Mo, W, Nb and Ta). High resistance to creep, rupture and TMF is created by the same constituents as the tensile capability but is further enhanced by the use of a very low Cr content.

It is also worth comparing the inventive alloys to the modern blade alloys. Relatively high Ta contents are common to modern blade alloys. There may be several compositional differences between the inventive alloys and modern blade alloys. The blade alloys are typically produced by casting techniques as their high-temperature capability is enhanced by the ability to form very large polycrystalline and/or single grains (also known as single crystals). Use of such blade alloys in powder metallurgical applications is compromised by the formation of very large grain size and their requirements for high-temperature heat treatment. The resulting cooling rate would cause significant quench cracking and tearing (particularly for larger parts). Among other differences, those blade alloys have a lower cobalt (Co) concentration than the exemplary inventive alloys. Broadly, relative to high-Ta modern blade alloys, the exemplary inventive alloys have been customized for utilization in disk manufacture through the adjustment of several other elements, including one or more of Al, Co, Cr, Hf, Mo, Nb, Ti, and W. Nevertheless, possible use of the inventive alloys for blades, vanes, and other non-disk components can't be excluded.

Accordingly, the possibility exists for optimizing a high-Ta disk alloy having improved high temperature properties (e.g., for use at temperatures of 1200-1500° F. (649-816° C.) or greater). It is noted that wherever both metric and English units are given the metric is a conversion from the English (e.g., an English measurement) and should not be regarded as indicating a false degree of precision.

The most basic η form is $Ni_3Ti$. It has generally been believed that, in modern disk and blade alloys, η forms when the Al to Ti weight ratio is less than or equal to one. In the exemplary alloys, this ratio is greater than one. From compositional analysis of the η phase, it appears that Ta significantly contributes to the formation of the η phase as $Ni_3$(Ti,Ta). A different correlation (reflecting more than Al and Ti) may therefore be more appropriate. Utilizing standard partitioning coefficients one can estimate the total mole fraction (by way of atomic percentages) of the elements that substitute for atomic sites normally occupied by Al. These elements include Hf, Mo, Nb, Ta, Ti, V, W and, to a smaller extent, Cr. These elements act as solid solution strengtheners to the γ' phase. When the γ' phase has too many of these additional atoms, other phases are apt to form, such as η when there is too much Ti. It is therefore instructive to address the ratio of Al to the sum of these other elements as a predictive assessment for η formation. For example, it appears that η will form when the molar ratio of Al atoms to the sum of the other atoms that partition to the Al site in γ' is less than or equal to about 0.79-0.81. This is particularly significant in concert with the high levels of Ta. Nominally, for NF3 this ratio is 0.84 and the Al to Ti weight percent ratio is 1.0. For test samples of NF3 these were observed as 0.82 and 0.968, respectively. The η phase would be predicted in NF3 by the conventional wisdom Al to Ti ratio but has not been observed. ME16 has similar nominal values of 0.85 and 0.98, respectively, and also does not exhibit the η phase as would be predicted by the Al to Ti ratio.

The η formation and quality thereof are believed particularly sensitive to the Ti and Ta contents. If the above-identified ratio of Al to its substitutes is satisfied, there may be a further approximate predictor for the formation of η. It is estimated that η will form if the Al content is less than or equal to about 3.5%, the Ta content is greater than or equal to about 6.35%, the Co content is greater than or equal to about 16%, the Ti content is greater than or equal to about 2.25%, and, perhaps most significantly, the sum of Ti and Ta contents is greater than or equal to about 8.0%.

With these various relationships in mind, a partially narrower (as to individual elements), partially broader, compositional range than the "Common" range of FIG. 3 is: a content of nickel as a largest content; 3.25-3.75 aluminum; 0.02-0.09 boron; 0.02-0.09 carbon; 9.0-11.0 chromium; 16.0-22.0 cobalt; 2.0-5.0 molybdenum; 1.0-3.5 niobium; 4.2-5.4 tantalum; 2.0-4.5 titanium; 1.8-2.4 tungsten; and 0.04-0.09 zirconium. This may be further specified by relationships above (one example being that a combined content of said tantalum, aluminum, titanium, and niobium is at least 11.5 weight percent; a combined content of titanium and niobium is 4.6-5.9 weight percent; and a combined content of tantalum and aluminum is 7.3-8.6 weight percent).

One or more embodiments have been described. Nevertheless, it will be understood that various modifications may be made. For example, the operational requirements of any particular engine will influence the manufacture of its components. As noted above, the principles may be applied to the manufacture of other components such as impellers, shaft members (e.g., shaft hub structures), and the like. Accordingly, other embodiments are within the scope of the following claims.

What is claimed is:

1. A composition of matter, comprising in combination, in weight percent:

a content of nickel as a largest content;
3.10-3.75 aluminum;
0.02-0.09 boron;
0.02-0.09 carbon;
9.5-11.25 chromium;
20.0-22.0 cobalt;
2.8-4.2 molybdenum;
1.6-2.4 niobium;
4.2-6.1 tantalum;
2.6-3.5 titanium;
1.8-2.5 tungsten; and
0.04-0.09 zirconium.

2. The composition of claim 1 comprising, in weight percent:

3.18-3.70 aluminum;
0.020-0.050 boron;
0.025-0.055 carbon;
10.00-10.85 chromium;
20.4-21.2 cobalt;
3.05-3.85 molybdenum;
1.70-2.29 niobium;
4.3-4.9 tantalum;
2.75-3.30 titanium;
1.9-2.4 tungsten; and
0.040-0.075 zirconium.

3. The composition of claim 1 consisting essentially of said combination.

4. The composition of claim 1 comprising, if any, in weight percent, no more than:

0.005 copper;
0.15 iron;
0.50 hafnium;
0.0005 sulfur;
0.1 silicon; and
0.1 vanadium.

5. The composition of claim 4 comprising, in weight percent, at least one of:

3.3-3.7 aluminum;
0.035-0.05 boron;
0.03-0.04 carbon;
10.0-10.4 chromium;
20.4-21.2 cobalt;
3.45-3.85 molybdenum;
1.89-2.29 niobium;
4.5-4.9 tantalum;
2.9-3.3 titanium;
2.0-2.4 tungsten; and
0.04-0.075 zirconium.

6. The composition of claim 1 comprising, in weight percent:

3.3-3.7 aluminum;
0.035-0.05 boron;
0.03-0.04 carbon;
10.0-10.4 chromium;
20.4-21.2 cobalt;
3.45-3.85 molybdenum;
1.89-2.29 niobium;
4.5-4.9 tantalum;
2.9-3.3 titanium;
2.0-2.4 tungsten;
0.04-0.075 zirconium; and no more than 1.0 percent, individually, of every additional constituent, if any.

7. The composition of claim 1 comprising, in weight percent:

3.18-3.63 aluminum;
0.020-0.030 boron;
0.025-0.055 carbon;
10.05-10.85 chromium;
20.60-21.20 cobalt;
3.05-3.55 molybdenum;
1.70-2.00 niobium;
4.3-4.70 tantalum;
2.75-3.25 titanium;
1.90-2.10 tungsten;
0.050-0.070 zirconium; and
no more than 1.0 percent, individually, of every additional constituent, if any.

8. The composition of claim 1 wherein:
said content of nickel is at least 50 weight percent.

9. The composition of claim 1 wherein:
said content of nickel is 50-53 weight percent.

10. The composition of claim 1 wherein a weight ratio of said titanium to said aluminum is at least 0.57.

11. The composition of claim 1 wherein:
a combined content of said tantalum, aluminum, titanium, and niobium is at least 11.5 percent.

12. The composition of claim 1 wherein:
a combined content of said tantalum, aluminum, titanium, and niobium is 12.0-14.2 weight percent.

13. The composition of claim 1 wherein:
a combined content of said titanium and niobium is 4.6-5.25 weight percent.

14. The composition of claim 1 wherein:
a combined content of said tantalum and aluminum is 7.6-8.2 weight percent.

15. The composition of claim 1 wherein:
a weight ratio of said aluminum to said tantalum is 0.7-0.8.

16. The composition of claim 1 wherein:
a weight ratio of said molybdenum to said tungsten is 1.6-1.9.

17. The composition of claim 1 further comprising:
no more than 4.0 weight percent, individually, of every additional constituent, if any.

18. The composition of claim 1 further comprising:
no more than 0.5 weight percent, individually, of every additional constituent, if any.

19. The composition of claim 1 further comprising:
no more than 4.0 weight percent, total, of every additional constituent, if any.

20. The composition of claim 1 in powder form.

21. A process for forming an article comprising:
compacting a powder having the composition of claim 1;
forging a precursor formed from the compacted powder; and
machining the forged precursor.

22. The process of claim 21 further comprising:
heat treating the precursor, at least one of before and after the machining, by heating to a temperature of no more than 1232° C. (2250° F.).

23. The process of claim 21 further comprising:
heat treating the precursor, at least one of before and after the machining, the heat treating effective to increase a characteristic γ grain size from a first value of about 10 μm or less to a second value of 20-120 μm.

24. A gas turbine engine turbine or compressor disk having the composition of claim 1.

25. A powder metallurgical article comprising:
a content of nickel as a largest content;
3.25-3.75 aluminum;
0.02-0.09 boron;
0.02-0.09 carbon;
9.0-11.0 chromium;
16.0-22.0 cobalt;
2.0-5.0 molybdenum;
1.0-3.5 niobium;
4.2-5.4 tantalum;
2.0-4.5 titanium;
1.8-2.4 tungsten; and
0.04-0.09 zirconium;
wherein:
a combined content of said tantalum, aluminum, titanium, and niobium is at least 11.5 weight percent;
a combined content of titanium and niobium is 4.6-5.9 weight percent; and
a combined content of tantalum and aluminum is 7.3-8.6 weight percent.

26. The powder metallurgical article of claim 25 being a gas turbine engine turbine or compressor disk.

* * * * *